US007282851B2

(12) United States Patent
Kijima et al.

(10) Patent No.: US 7,282,851 B2
(45) Date of Patent: Oct. 16, 2007

(54) DISPLAY DEVICE

(75) Inventors: Yuuichi Kijima, Chosei (JP); Yoshiyuki Kaneko, Hachioji (JP); Shigemi Hirasawa, Chiba (JP); Susumu Sasaki, Chiba (JP); Tomoki Nakamura, Mobara (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 0 days.

(21) Appl. No.: 11/439,267

(22) Filed: May 24, 2006

(65) Prior Publication Data

US 2006/0208629 A1 Sep. 21, 2006

Related U.S. Application Data

(63) Continuation of application No. 10/610,626, filed on Jul. 2, 2003, now Pat. No. 7,053,544.

(30) Foreign Application Priority Data

Jul. 8, 2002 (JP) ..... 2002-198498

(51) Int. Cl.
*H01J 63/04* (2006.01)

(52) U.S. Cl. ..... 313/495; 313/496; 313/497; 313/293; 313/304

(58) Field of Classification Search ..... 313/495
See application file for complete search history.

(56) References Cited

U.S. PATENT DOCUMENTS

| | | | | |
|---|---|---|---|---|
| 4,857,799 | A | 8/1989 | Spindt | |
| 5,534,744 | A | 7/1996 | Leroux | |
| 5,574,333 | A | 11/1996 | Clerc | |
| 5,600,203 | A | 2/1997 | Namikawa | |
| 5,729,087 | A | 3/1998 | Chien | |
| 5,759,078 | A | 6/1998 | Levine | |
| 6,060,841 | A | 5/2000 | Nilyama | |
| 6,066,915 | A | 5/2000 | Pepi | |
| 6,437,503 | B1 | 8/2002 | Konuma | |
| 6,770,540 | B2 | 8/2004 | Ko | |
| 7,053,544 | B2 * | 5/2006 | Kijima et al. | 313/495 |
| 2004/0007965 | A1 * | 1/2004 | Kijima et al. | 313/495 |

FOREIGN PATENT DOCUMENTS

| | | |
|---|---|---|
| JP | 2-500065 | 1/1990 |
| JP | 05-047354 | 2/1993 |
| JP | 10-326585 | 12/1998 |
| JP | 10-340666 | 12/1998 |
| JP | 2000-243218 | 9/2000 |
| JP | 2001-176376 | 6/2001 |
| JP | 2002-216679 | 8/2002 |
| KR | 2001-46804 | 8/2001 |

* cited by examiner

*Primary Examiner*—David Bruce
*Assistant Examiner*—Conrad R Blease
(74) *Attorney, Agent, or Firm*—Antonelli, Terry, Stout & Kraus, LLP.

(57) ABSTRACT

A display device includes a back substrate having a plurality of cathode lines, and a plurality of control electrodes, which are insulated from the cathode lines on an inner surface thereof, and a front substrate which is arranged to face the back substrate in an opposed manner with a set distance therebetween, and which has phosphors and an anode which constitute a display region, on an inner surface thereof. Distance holding members are provided for maintaining the set distance between the back substrate and the front substrate inside of the display region. The phosphors are constituted of three colors, and the cathode lines are formed into groups each consisting of three cathode lines corresponding to the three colors. The plurality of cathode lines include line portions and cathode portions which are wider than the line portions. Electron sources are formed on the cathode portions.

9 Claims, 13 Drawing Sheets

DISPLAY DEVICE

CROSS REFERENCE TO RELATED APPLICATION

This application is a continuation application of U.S. application Ser. No. 10/610,626, filed Jul. 2, 2003, now U.S. Pat. No. 7,053,544,the contents of which are incorporated herein by reference.

BACKGROUND OF THE INVENTION

The present invention relates to a display device which utilizes the emission of electrons into a vacuum in response to application of an electric field; and, more particularly, the invention relates to a field emission type display device, which is formed by laminating a back substrate, on which a large number of cathode lines and a large number of control electrodes constituting an electron emission mechanism are formed, and a front substrate, on which phosphors and anodes are formed.

As a display device which exhibits a high brightness and a high definition, color cathode ray tubes have been widely used conventionally. However, along with the recent request the higher quality in the generation of images in information processing equipment or television broadcasting, there has been an increased demand for planar displays (panel displays), which are light in weight and require a small space, while exhibiting a high brightness and a high definition.

As typical examples, liquid crystal display devices, plasma display devices and the like have been commercialized. Further, as display devices which can realize a higher brightness, it is expected that various kinds of panel-type display devices, including a display device which utilizes the emission of electrons from electron emitting sources into a vacuum (hereinafter, referred to as "an electron emission type display device" or "a field emission type display device (FED)"), and an organic EL display device (OLED) which is characterized by low power consumption, will be commercialized.

Among such panel type display devices, there are various types of field emission type display devices, including a display device having an electron emission structure as developed by C. A. Spindt et al, a display device having an electron emission structure of a metal-insulator metal (MIM) type, a display device having an electron emission structure which utilizes an electron emission phenomenon based on a quantum theory tunneling effect (also referred to as a "surface conduction type electron emitting source), and a display device which utilizes an electron emission phenomenon possessed by a diamond film, a graphite film and carbon nanotubes and the like.

The field emission type display device includes a back panel, on which cathode lines having electron-emission-type electron sources and control electrodes are formed on an inner surface thereof, and a front panel, on which anodes and phosphors are formed on an inner surface which faces the back panel; wherein, both panels are laminated to each other by inserting a sealing frame between the inner peripheries of both panels, and the inside space thereof is evacuated. Further, to set a distance between the back substrate and the front substrate to a given value, distance holding members are provided between the back panel and the front panel in places where there are neither cathode lines nor control electrodes.

The back panel includes a plurality of cathode lines and control electrodes, which constitute electron sources, on a back substrate, which is preferably made of glass, alumina or the like. The cathode lines extend in a first direction and are juxtaposed in a second direction in a large number on the back substrate. The control electrodes are insulated from the cathode lines and are arranged in the vicinity of the cathode lines. The control electrodes extend in the second direction and are juxtaposed in the first direction in a large number. At a crossing portion of a cathode line (the electron source provided to the cathode line) and a control electrode, one pixel (a unit pixel in a monochromatic display) or one unit pixel (in case of color display, one color pixel being constituted of three unit pixels of, for example, red (R), green (G), blue (B)) is formed, wherein one pixel implies each unit pixel of R, G, B (hereinafter, these elements are referred to as a pixel as a general term). The emission quantity (including ON/OFF states) of electrons from the electron source is controlled in response to the potential difference between the cathode lines and the control electrodes.

On the other hand, the front panel includes anodes and phosphors disposed on the front substrate, which is formed of a light transmitting material, such as glass or the like. The inside space between panels, which is sealed by a sealing frame, is evacuated to a vacuum of $10^{-5}$ to $10^{-7}$ Torr, for example. Each control electrode includes electron passing apertures at each crossing portion of a cathode line and a control electrode, wherein electrons which are emitted from the electron source of the cathode line are allowed to pass through the electron passing apertures to the anode side. The electron source is constituted of, for example, a carbon nanotube (CNT), diamond-like carbon (DLC), a so-called Spindt, or other electric field emission cathode (hereinafter also simply referred to as a cathode).

The cathode lines are juxtaposed with each other with a gap therebetween. Further, the control electrode is constituted of a plate-like thin metal plate, a metal mesh or a metal vapor deposition film having electron passing apertures. In case of the metal mesh, mesh holes constitute the electron passing apertures. In case of the metal vapor deposition film, an insulating layer is formed between the cathode line and the metal vapor deposition film, and a metal film having the electron passing apertures is vapor-deposited. The insulating layer at a portion of the electron source which corresponds to the electron passing apertures is removed.

SUMMARY OF THE INVENTION

Recently, the inventors of the present invention proposed a type of control electrode which uses a ribbon-like thin metal plate as the control electrode. This type of control electrode is referred to as a metal ribbon grid (MRG). Such a control electrode is formed by applying a photolithography method or the like to a thin metal plate, wherein one or a plurality of electron passing apertures are formed in each ribbon-like electrode for every pixel.

FIG. 16(*a*) and FIG. 16(*b*) are schematic views illustrating the overall structure of a field emission type display device which uses ribbon-like thin metal plates as control electrodes, wherein FIG. 16(*a*) is a developed perspective view and FIG. 16(*b*) is a cross sectional view. Here, in FIG. 16(*a*) and FIG. 16(*b*), minute structural details are omitted. In the drawing, reference symbol Pill indicates a back panel, reference symbol PN2 indicates a front panel, and reference symbol MFL indicates a sealing frame. On an inner surface of a back substrate SUB1, which constitutes the back panel PN1, there are a large number of cathode lines CL, which extend in a first direction (y direction) and are juxtaposed in a second direction (x direction), which crosses the y direction. Over the cathode lines CL, there are a large number of control electrodes MRG, which extend in the x direction and are juxtaposed in the y direction. On the other hand, on an inner surface of the front substrate SUB2, which constitutes the front panel PN2, anodes APE and phosphors PHS are formed. The front panel PN2 is laminated to the back panel PN1 by way of the sealing frame MFL in the orthogonal direction (z direction).

Insulating layers INS are interposed between the cathode lines CL and the control electrodes MRG formed on the back substrate SUB1. Cathode line pull-out terminals CL-T are extended out from the cathode lines CL and control electrode pull-out terminals MRG-T are extended out from the control electrodes MRG. Further, reference symbol EXC indicates an exhaust tube. After laminating the back panel PN1 and the front panel PN2 to each other, the space defined between these panels is evacuated, such that a desired degree of vacuum is obtained, using the exhaust tube EXC.

In such a display device, along with the enhancement of definition of a display image, the cathode lines and the control electrodes become fine or minute; and, hence, one of the objectives to be achieved is to align the cathode lines and the control electrodes with high accuracy. However, with enhancement of the definition, it is difficult to hold the gap between the cathode lines and the control electrodes at a uniform level. Further, with respect to the display device in which the electron sources are formed on the cathode lines CL, the finer the cathode lines C1 are, the smaller the regions where the electron sources are formed become, so that it is difficult to mount a sufficient number of electron sources. This also constitutes a problem to be solved by the present invention.

Accordingly, it is an object of the present invention to provide a display device which can ensure sufficient electronic source regions for cathode lines formed on a back substrate and to align control electrodes in the electron source regions with high accuracy.

It is another object of the present invention to realize a display device having high accuracy and high reliability by holding and fixing the cathode lines and control electrodes uniformly and easily.

To achieve the above-stated objects, according to the present invention, each cathode line is divided into a line portion (a bus line) and an area representing a cathode portion, wherein the line portion is narrowed to a width which is a required minimum for transmitting signals, and the area of the cathode portion on which an electron source is formed is more widely formed to have an island shape. Further, a plurality of cathode lines are formed into a group, wherein each cathode portion is formed at a position corresponding to electron passing apertures formed in the control electrode; and, hence, the gap between the line portions is made small, whereby relatively large spaces are ensured between the neighboring groups. By making use of this space, the tolerance in mounting the control electrodes on the back substrate can be increased.

Further, by forming dot-like or linear projecting portions (bridges) on the back substrate side of the control electrode, and by bringing these projecting portions into contact with the back substrate in the space portions, it is possible to ensure a given gap between the cathode line and the control electrode Further, distance holding members for maintaining a space between the back substrate and the front substrate at a given value at the time of laminating the front substrate to the back substrate are formed, making use of above-mentioned space.

Due to such a constitution, by enlarging the cathode area, the alignment between these cathodes and the electron passing apertures of the control electrodes is facilitated, so that an improvement in the easiness of assembling can be realized. As a result, the yield rate is enhanced and a reduction of the cost can be realized.

Typical constitutions of the present invention are as follows.

(1) In a display device including:

a back substrate having a large number of cathode lines which extend in a first direction and are juxtaposed in a second direction which crosses the first direction, and a large number of control electrodes which extend in the second direction, are juxtaposed in the first direction, and are arranged over the cathode lines with a given gap therebetween, and which have electron passing apertures at crossing portions between the control electrodes and the cathode lines, on an inner surface thereof; and a front substrate, which is arranged to face the back substrate in an opposed manner with a given distance therebetween, has phosphors and an anode, which are arranged at positions facing the electron passing apertures of the control electrodes and constitute a display region, on an inner surface thereof which faces the inner surface of the back substrate in an opposed manner;

the display device further includes distance holding members for maintaining a distance between the back substrate and the front substrate within the display region; and the large number of cathode lines include line portions, which extend in the first direction, and cathode portions, which are integrally formed with the line portions at crossing portions between the cathode lines and the control electrodes and have an area larger than an area of the line portions, and electron sources are formed on portions of the cathode portions which face the electron passing apertures of the control electrode.

(2) In the constitution (1), the cathode lines are formed into groups each constituting a plurality of cathode lines, and the distance between the cathode lines in the neighboring groups is set to be equal to the distance between the cathode lines within the same group.

(3) In the constitution (1), the cathode lines are formed into groups each constituting a plurality of cathode lines, and the distance between the cathode lines in a neighboring group is set larger than the distance between the cathode lines within the same group.

(4) In the constitution (2) or (3), the cathode portions which are positioned so as to be spaced from the center of each group of the cathode lines toward the end portion sides in the second direction are asymmetrical with respect to the line portion which constitutes the cathode portion.

(5) In any one of the constitutions (2) to (4), the phosphors are constituted of three colors (red, green, blue), and there are three cathode lines to a group corresponding to the three colors (red, green, blue).

(6) In the constitution (5), the cathode portion of the cathode line at the center of a group is symmetrical with respect to the extending direction of the line portion, and the cathode portions of the cathode lines at both sides are asymmetrical with respect to the extending direction of the line portion.

(7) In any one of the constitutions (2) to (6), an insulating layer, which holds the control electrodes on the back substrate at a given gap, is arranged between the groups.

(8) In anyone of the constitutions (2) to (6), projecting portions which are brought into contact with the back substrate and maintain a given gap are provided at the back substrate side of the control electrodes, and the projecting portions are positioned between the groups.

(9) In any one of the constitutions (1) to (8), distance holding members which maintains a given distance between the back substrate and the front substrate are provided to the back substrate side.

(10) In any one of the constitutions (2) to (8), the distance holding members are arranged between the groups.

(11) In the constitution (10), the distance holding members are brought into contact with the back substrate between the control electrodes.

Here, it is needless to say that the present invention is not limited to the above-mentioned constitutions, and the constitutions of respective embodiments, which will be explained later, and various modifications are conceivable without departing from the technical concept of the present invention.

DESCRIPTION OF THE PREFERRED EMBODIMENTS

Preferred embodiments of the present invention will be explained in detail hereinafter in conjunction with the drawings.

Figure 1:
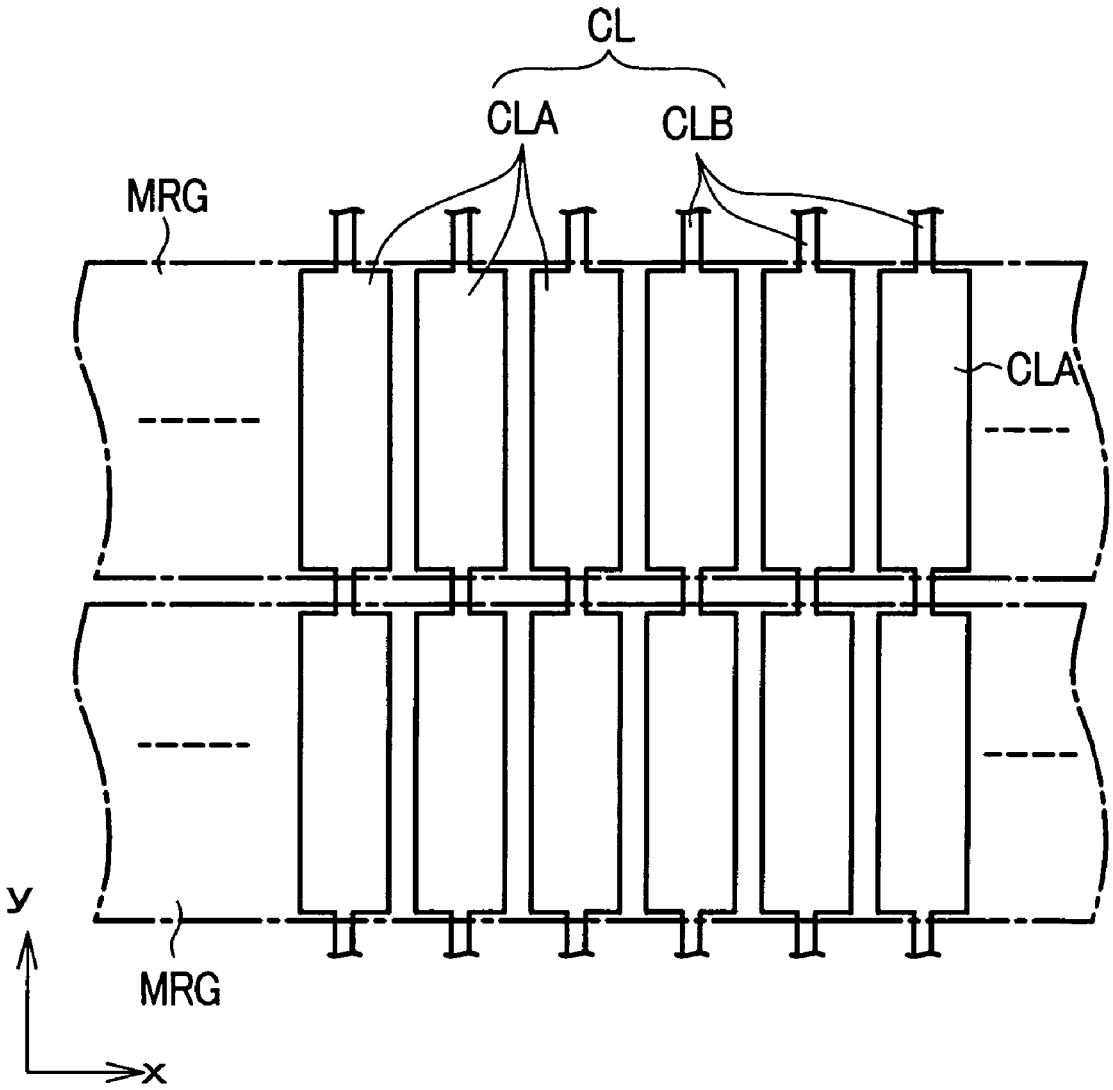
FIG. 1 is a schematic diagram showing a plan view of part of the cathode lines formed on a back panel, illustrating a first embodiment of a display device according to the present invention.
Figure 2:
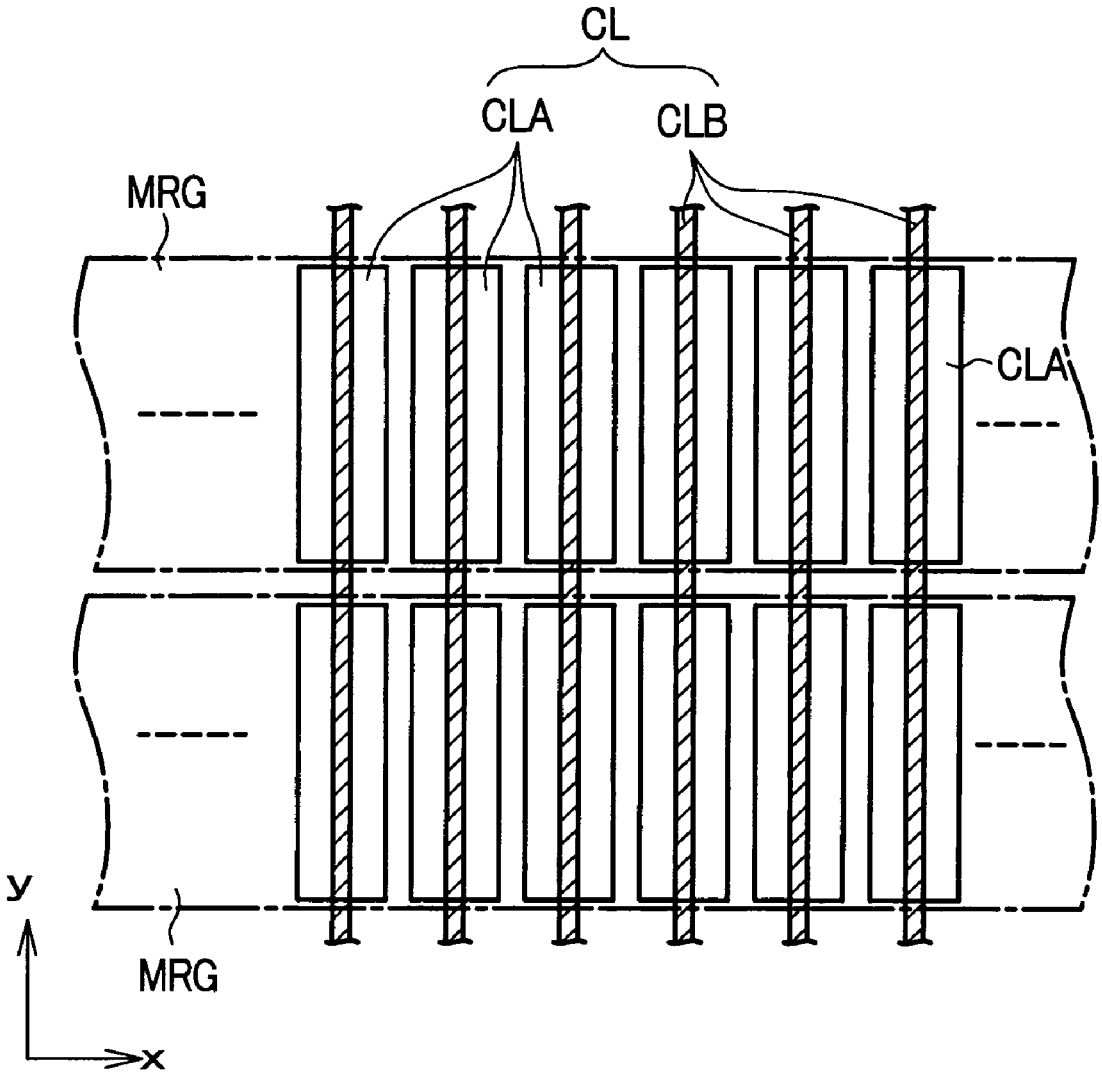
FIG. 2 is a schematic diagram showing the constitution of the cathode line in FIG. 1.

FIG. 1 is a plan view showing part of the cathode lines formed on a back panel in a first embodiment of a display device according to the present invention. FIG. 2 is a plan view showing the constitution of the cathode lines in FIG. 1 in a more readily understandable manner, wherein each cathode line is constituted of a cathode portion and a line portion. In FIG. 1 and FIG. 2, the reference symbol CLB indicates a line portion and the reference symbol CLA indicates a cathode portion. Here, reference symbol MRG indicates a control electrode, which is depicted by an imaginary line. Electron passing apertures are formed in the control electrode MRG, as will be explained later. In this embodiment, the cathode line CL is constituted of the line portion CLB and the cathode portion CLA.

The cathode line CL is formed of a metal film made of indium tin oxide (ITO), chromium, copper, aluminum or the like, an alloy thereof, a film formed of a laminated body of these metal films, or a printing of a conductive paint, such as a silver paste. Although it is preferable to form the line portions CLB and the cathode portions CLA in the same processing step simultaneously, it is possible to perform the formation of the line portions CLB and the formation of cathode portions CLA in separate steps. However, in the embodiments of the present invention, including this embodiment, the explanation will be directed to the case in which the line portions CLB and the cathode portions CLA are simultaneously formed in the same processing step. At the time of forming the cathode line CL, the cathode portion CLA is formed to be wider (having a larger area) than the line portion CLB. The shape of the cathode portion CLA is a rectangular shape, having the long sides thereof extending in the width direction (y direction) of the control electrode MRG. An electron source, such as carbon nanotubes or the like, is formed on the cathode portion CLA. In the embodiment shown in FIG. 1, the line portions CLB of the cathode lines CL are equidistantly spaced apart from each other in the arrangement direction (x direction) of the cathode lines CL, and respective cathode portions CLA are arranged symmetrically with respect to the extending direction (y direction) of the line portion CLB.

In this embodiment, by making the area of the cathode portion CLA of the cathode line CL wider than the area of the line portion CLB, it is possible to ensure the large area necessary for mounting the electron source. Accordingly, in mounting the electron source, the position where the electron source is formed can be easily determined, and, therefore, the electron source mounting operation is facilitated.

As a result, it is possible to increase the quantity of electrons emitted from the electron source, and, hence, sufficient electrons as required for the display device can be ensured. Here, the line portion CLB is made as narrow as possible, provided that there arises no problem with respect to the electrical resistance necessary for applying a given cathode voltage. Further, the line portion CLB is made preferably narrow from the viewpoint of obviating any contact of the line portion CLB with other parts. Here, the alignment operation which is performed in the control electrode MRG assembling step, following mounting of the electron sources, is also facilitated.

Figure 3:
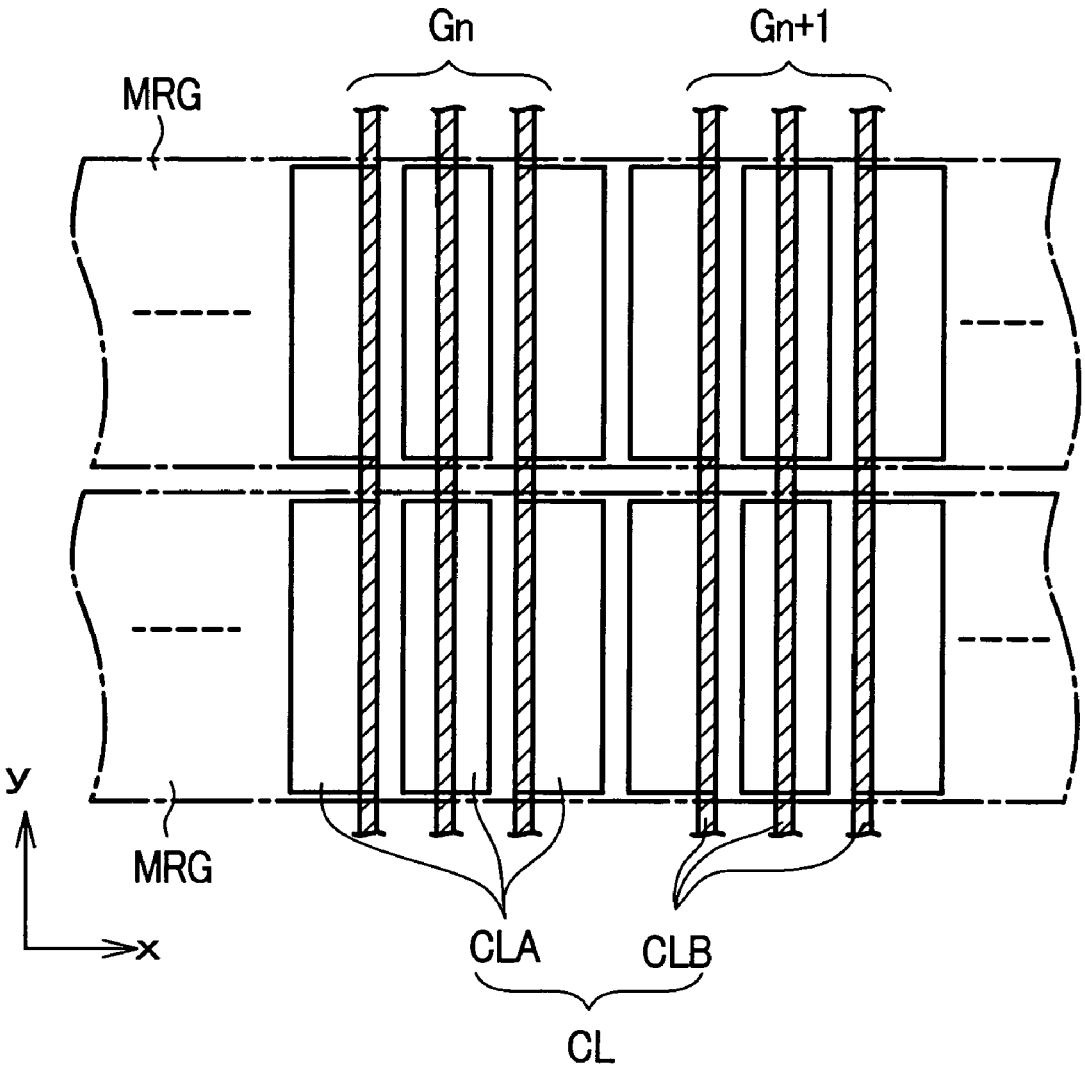
FIG. 3 is a schematic diagram showing a plan view of part of the cathode lines formed on a back panel, illustrating a second embodiment of the display device according to the present invention.

FIG. 3 is a plan view showing part of the cathode lines CL that are formed on a back panel in a second embodiment of the display device according to the present invention. Reference symbols which are the same as those in FIG. 1 and FIG. 2 correspond to identical functional portions. Although each cathode line CL of this embodiment is equal to that of the first embodiment with respect to the point that the area of the cathode portion CLA is set to be larger than that of the line portion CLB, this embodiment differs from the first embodiment with respect to a following point. That is, in this embodiment, the cathode lines CL are arranged into groups (also referred to as a grouping) by dividing the cathode lines CL into groups each consisting of a plurality of cathode lines CL. In FIG. 3, a group Gn and a group Gn+1, which are arranged close to each other, are shown. Here, one group is constituted of three cathode lines corresponding to one color trio pixel (R, G, B). The cathode portion CLA of the cathode line CL which is positioned at the center of the group spreads in a left-and-right symmetry with respect to the extending direction (y direction) of the line portion CLB, while respective cathode portions CLA of the cathode lines CL that are arranged at both sides of the group are formed such that they spread in the direction away from each other with the same area in a left-and-right asymmetry in the x direction with respect to respective line portions CLB at both sides. The cathode portions CLA have a rectangular shape and all of them are arranged at an equal pitch in the x direction over the whole display region. Here, it may be possible to increase the area of the cathode portion corresponding to a color which exhibits weak chromaticity and luminance.

Due to the constitution of this embodiment, it is possible to ensure a large plain region on a substrate surface of the back substrate on which the line portions CLB are formed, and, hence, the mounting tolerance of insulating layers and space holding means, which will be explained later, can be increased. Here, the number of cathode lines which constitute one group in a grouping is not limited to three. A constitution of cathode portions in which four or more cathode lines are grouped as one unit follows the constitution in which three cathode lines are grouped as one unit. That is, the cathode portions are arranged in a left-and-right asymmetry and with an equal area being provided in the x direction with respect to the line portions toward the outside from the center portion of the group. Alternatively, the cathode portions may be arranged in the above-mentioned manner, while increasing the area of the cathode portions corresponding to a color having weak chromaticity and luminance.

Figure 4:
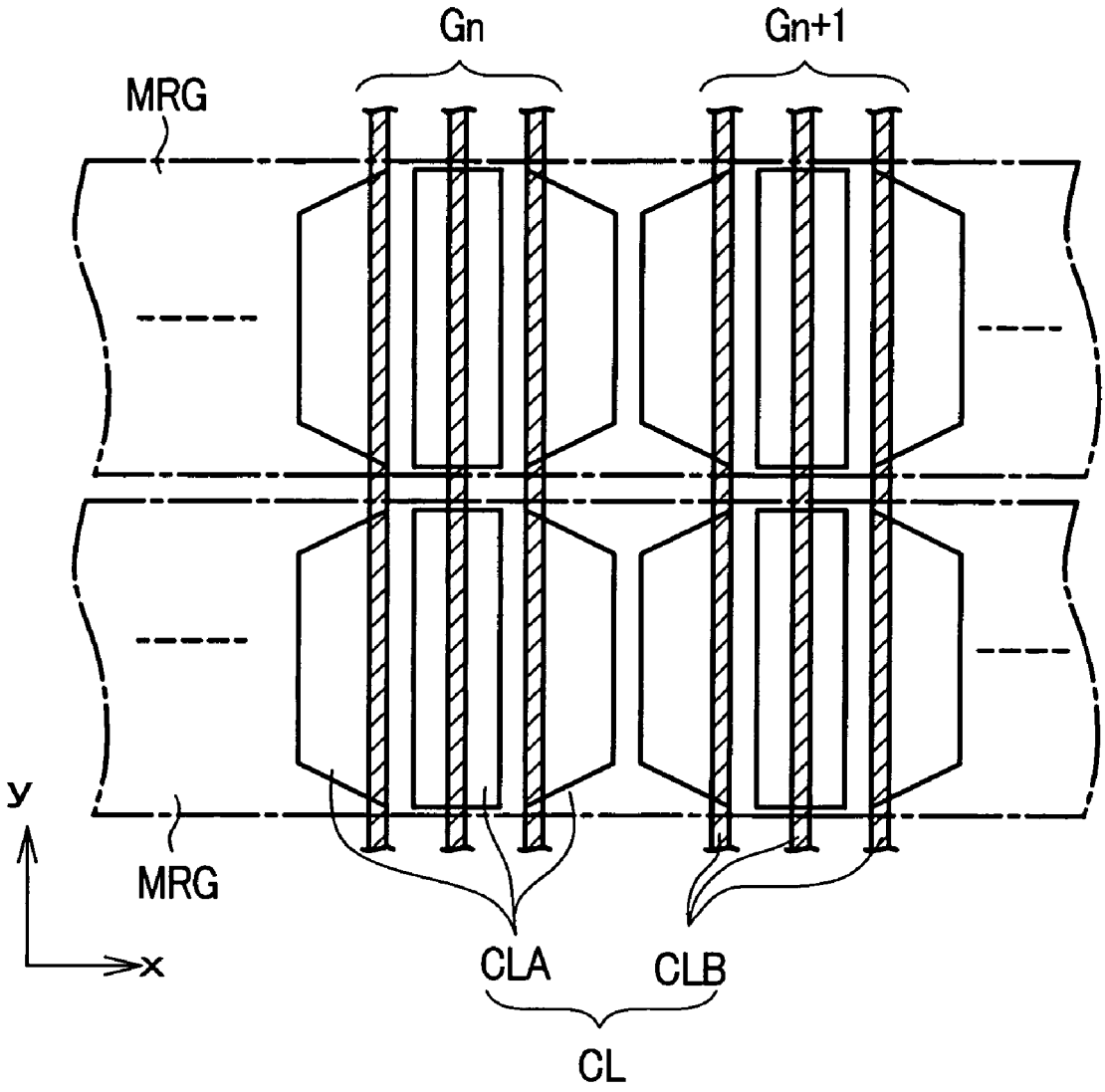
FIG. 4 is a schematic diagram showing a plan view of part of the cathode lines formed on a back panel, illustrating third embodiment of the display device according to the present invention.

FIG. 4 is a plan view showing part of the cathode lines formed on a back panel in the third embodiment of the display device according to the present invention. Reference symbols which are the same as those in FIG. 1 to FIG. 3 correspond to identical functional portions. This embodiment also adopts the grouping arrangement in which three cathode lines are arranged into one group in the same manner as the second embodiment that has been explained in conjunction with FIG. 3. In FIG. 4, a group Gn and a group Gn+1, which are arranged close to each other, are shown. As shown in the drawing, the shape of the cathode portions CLA of cathode lines CL, which are positioned at the left and right sides within the group, differs from the shape of the cathode portion CLA of the cathode line CL which is positioned at the center. That is, the sides in the x direction of the cathode portions CLA of the cathode lines CL, which are positioned at the left and right sides, are formed into a shape such that the corners thereof are cut obliquely in the y direction. Although the areas of the cathode portions CLA of three cathode lines are shown to be equal, the area of the cathode portion corresponding to a color having weak chromaticity and luminance may be increased.

Due to the features of this embodiment, it is possible to ensure a larger plain region on a substrate surface of the back substrate on which the line portions CLB are formed, and, hence, the mounting tolerance of insulating layers and space holding means, which will be explained later, can be increased. Here, in the same manner as the second embodiment, the number of cathode lines CL which constitute one group in a grouping is not limited to three. A constitution of the cathode portions CLA in which four or more cathode lines CL are grouped as one unit follows the constitution in which three cathode lines CL are grouped as one unit. That is, the cathode portions CLA are arranged in a left-and-right asymmetry and with an equal area in the x direction with respect to the line portions CLB toward the outside from the center portion of the group. Alternatively, the cathode portions CLA may be arranged in the above-mentioned manner, while increasing the area of the cathode portions CLA corresponding to a color having weak chromaticity and luminance.

Figure 5:
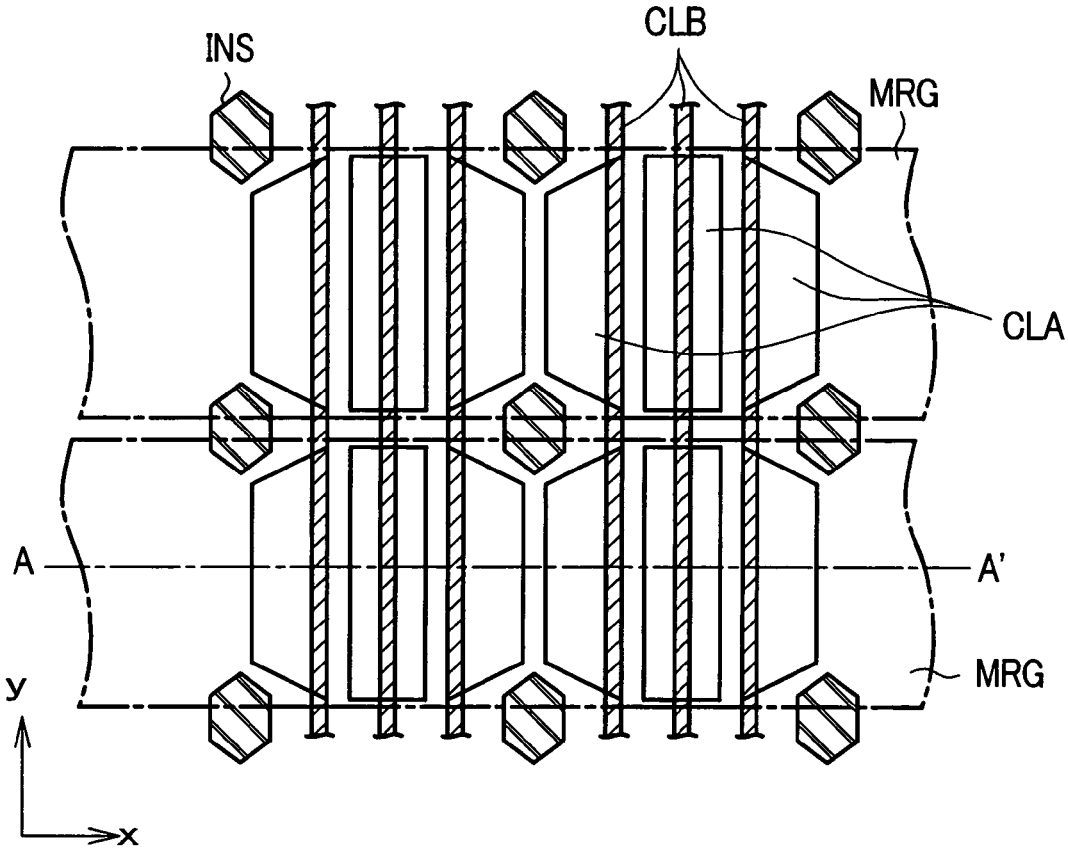
FIG. 5(*a*) is a plan view, and FIG. 5(*b*) is a sectional view taken along line B-B' in FIG. 5(*a*), showing part of the combination of the back panel and a front panel in a fourth embodiment of the display device according to the present invention.
Figure 5:
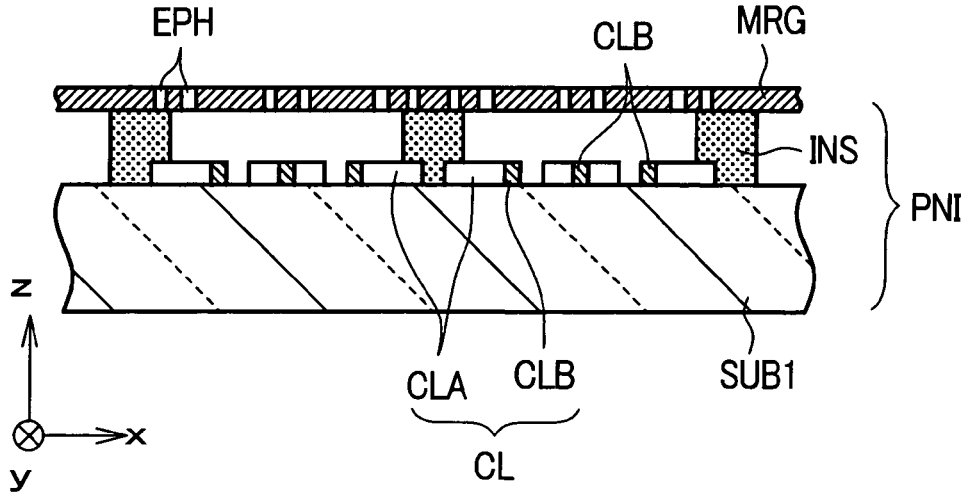

FIG. 5(*a*) and FIG. 5(*b*) show part of the combination of a back panel and a front panel in a fourth embodiment of the display device according to the present invention, wherein FIG. 5(*a*) is a plan view and FIG. 5(*b*) is a cross-sectional view taken along a A-A' line in FIG. 5(*a*). In the drawing, reference symbol SUB1. indicates a back substrate, reference symbol INS indicates insulating layers, reference symbol MRG indicates control electrodes, reference symbol EPH indicates electron passing apertures, reference symbol PN1 indicates a back panel, and other symbols which are the same as the reference symbols in the drawings of the previous embodiments indicate identical functional portions. In this embodiment, the control electrodes MRG are mounted on the back substrate SUB1 on which the cathode lines are formed, as explained in conjunction with FIG. 4, by way of the insulating layers INS.

The control electrode MRG is formed of a ribbon-like thin metal plate and includes a plurality of electron passing apertures EPH at positions corresponding to respective cathode portions CLA. This control electrode MRG is arranged at a level equal to the height of the insulating layers INS, so that a given gap is maintained between the control electrode MRG and the cathode line (cathode portion CLA). The insulating layers INS are arranged at spaces on the substrate surface which are ensured by cutting the cathode portions CLA that are positioned outside the cathode lines, which are formed into a group. Although the cross-sectional shape of the insulating layer INS is shown as a hexagonal shape corresponding to the shape of the above-mentioned cut portions, the shape is not limited to such a shape and may be a circular shape, an elliptical shape or other polygonal shape. Further, the insulating layers INS which are arranged close to each other in the x direction, in the y direction, or in the x-y directions may be connected to each other.

The electron passing apertures EPH in the control electrode MRG are formed at positions corresponding to the cathode portions CLA of the cathode lines CL (right above the cathode portion CLA). The number, the size and the shape of the arrangement are not limited to those shown in the drawing. According to this embodiment, the insulating layers INS, which are provided for mounting the control electrodes MRG on the back substrate SUB1, can be arranged on spaces on the surface of the substrate which can be assured by grouping the cathode lines CL with a large tolerance. Further, since the cross-sectional area of the insulating layers INS can be increased, it is possible to mount the control electrodes MRG accurately and firmly.

Figure 6:
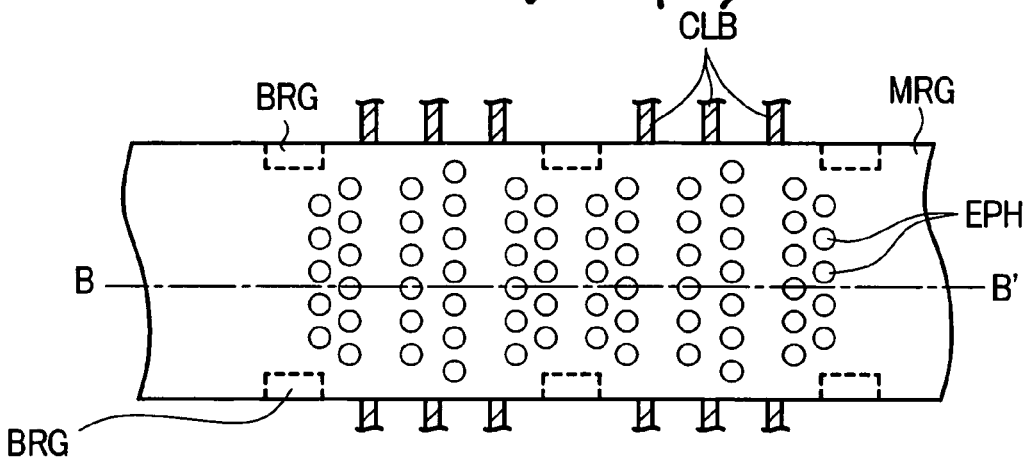
FIG. 6(*a*) and FIG. 6(*b*) are plan views, and FIG. 6(*c*) is a sectional view taken along line B-B' in FIG. 6(*a*), showing part of the combination of the back panel and the front panel in a fifth embodiment of the display device according to the present invention.
Figure 6:
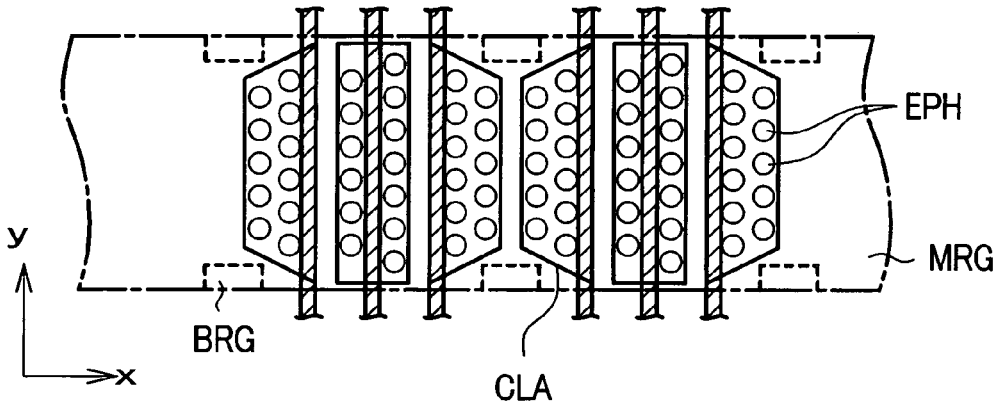
Figure 6:
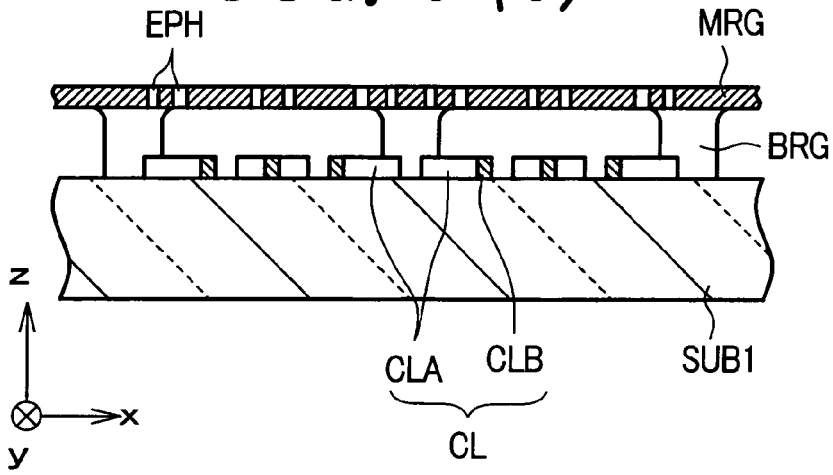

FIG. 6(*a*), FIG. 6(*b*) and FIG. 6(*c*) show part of the combination of a back panel and a front panel in a fifth embodiment of the display device according to the present invention. In these drawings, FIG. 6(*a*) is a plan view, FIG. 6(*b*) is a plan view of a back substrate in a state in which control electrodes shown in FIG. 6(*a*) are removed, and FIG. 6(*c*) is a cross-sectional view taken along a line B-B' in FIG. 6(*a*). Here, as seen in FIG. 6(*b*), the electron passing apertures EPH that are formed in the control electrode MRG are indicated by a solid line so as to clarify the positional relationship between the electron passing apertures EPH and the cathode portions CLA of cathode lines CL. In FIG. 6(*a*), FIG. 6(*b*) and FIG. 6(*c*), reference symbols which are the same as those in FIG. 5(*a*) and FIG. 5(*b*) correspond to identical functional portions. In this embodiment, on a back surface, that is, on a cathode line side of the control electrode MRG, projecting portions BRG are integrally formed, and these projecting portions BRG are brought into contact with a substrate surface of a back substrate SUB1 so as to ensure a given gap between the control electrode MRG and the cathode line CL. Also, in this embodiment, on the back substrate SUB1 on which the cathode lines CL are formed, as explained in conjunction with FIG. 4, the control electrodes MRG are mounted.

In the same manner as the embodiment shown in FIG. 5(*a*) and FIG. 5(*b*), the electron passing apertures EPH, that are formed in the control electrode MRG, are formed at positions corresponding to the cathode portions CLA of the cathode lines CL (right above the cathode portions CLA). The number, the size and the shape of arrangement are not limited to those shown in the drawing. The projecting portions BRG formed on the control electrodes MRG are formed simultaneously at the time of forming the control electrodes MRG using a photolithography process or the like. Although the projecting portions ERG are shown in a state in which they have a rectangular cross section in FIG. 6(*a*), FIG. 6(*b*) and FIG. 6(*c*), the cross section of the projecting portions is not limited to such a shape and may be formed to have a circular shape, an elliptical shape or other polygonal shape. Further, these projecting portions BRG may be arranged to be connected to each other at portions where the cathode lines CL in the x direction, in the y direction or in the x-y directions are not present. According to this embodiment, the projecting portions BRG, which are provided for mounting the control electrodes MRG on the back substrate SUB1, can be arranged on spaces on the surface of the substrate which can be assured by grouping the cathode lines CL with a large tolerance. Further, since the cross-sectional area. of the projecting portions BRG can be increased, it is possible to mount the control electrodes MRG accurately and firmly.

Figure 7:
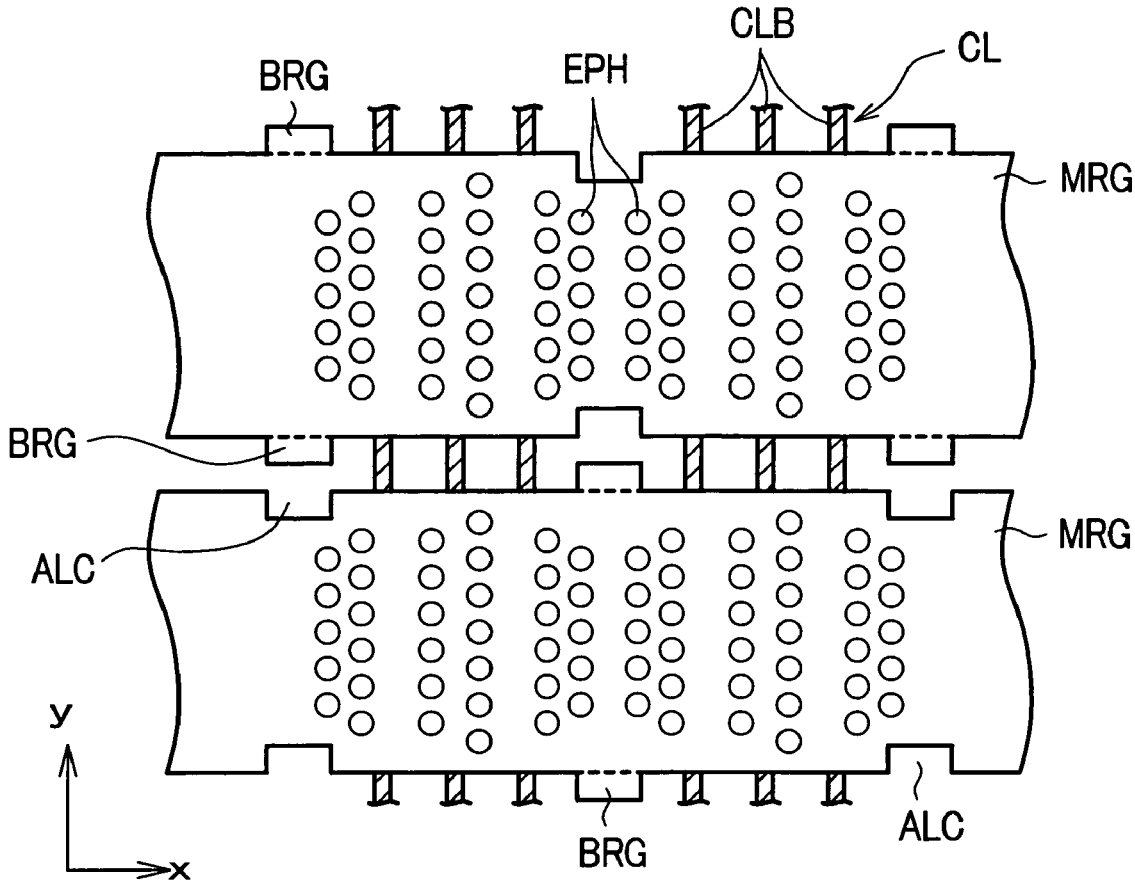
FIG. 7 is a plan view of part of the combination of the back panel and the front panel in a sixth embodiment of the display device according to the present invention.

FIG. 7 shows part of the combination of a back panel and a front panel in a sixth embodiment of the display device according to the present invention. In this embodiment, the projecting portions BRG of the control electrodes MRG, that were described in conjunction with FIG. 6(*a*), FIG. 6(*b*) and FIG. 6(*c*), are formed such that they are displaced or shifted in the x direction between the neighboring control electrodes MRG. Further, the positions of the projecting portions ERG are projected in the direction (y direction) which crosses the extending direction of the control electrode MRG, and portions of the neighboring electrode MRG corresponding to the above-mentioned projecting portions are indented to form recesses ALC.

According to this embodiment, in addition to the advantageous effect obtained by the fifth embodiment, it is possible to extend the cathode portions of the cathode lines CL into spaces where the projecting portions BRG are not present. As a result, it is possible to increase the area of the cathode portions, whereby the electron emission quantity can be increased.

Figure 8:
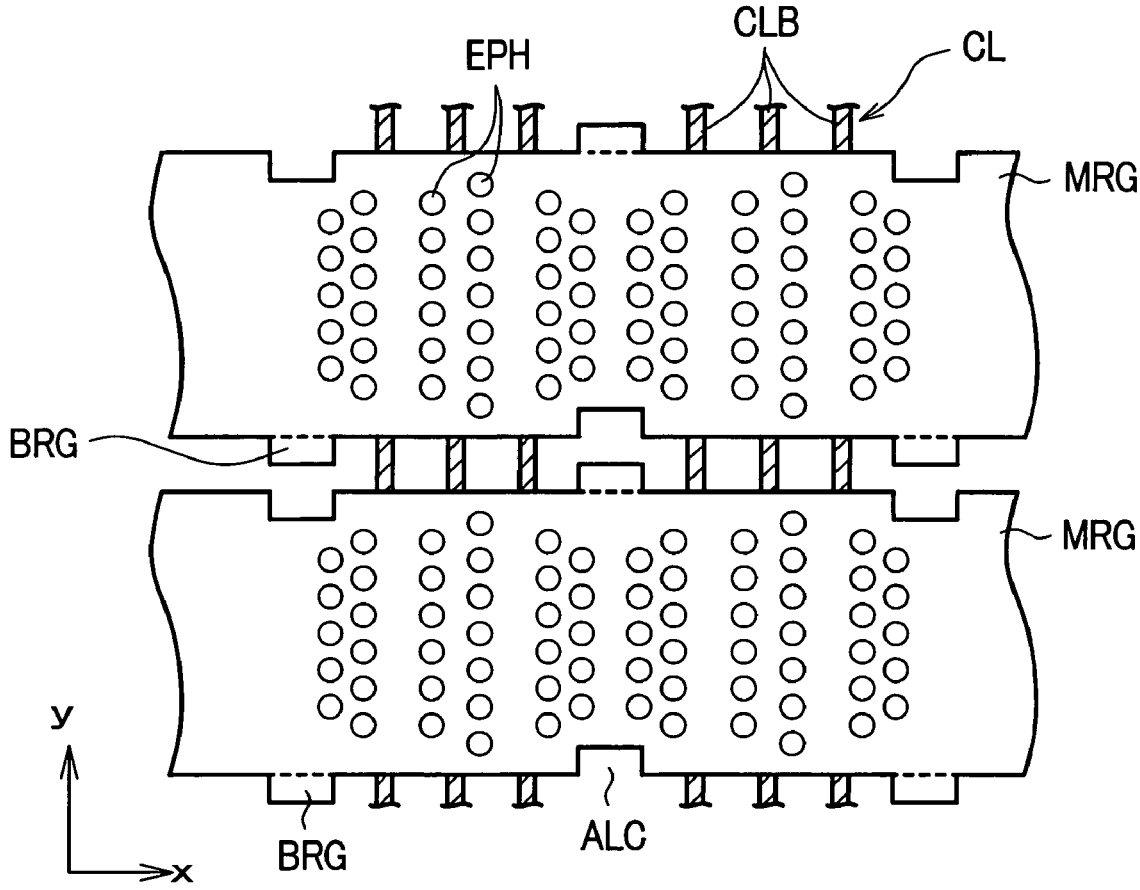
FIG. 8 is a plan view of part of the combination of the back panel and the front panel in a seventh embodiment of the display device according to the present invention.

FIG. 8 shows part of the combination of a back panel and a front panel in a seventh embodiment of the display device according to the present invention. In this embodiment, the projecting portions BRG, which were described in conjunction with the embodiment shown in FIG. 7, are arranged at the seine position with respect to the neighboring control electrodes MRG. That is, when the projecting portions BRG are present in the y direction, as seen in the drawing, within the same control electrode MRG, the projecting portions BRG are not formed in the direction opposite to the y direction, and the recesses ALC are formed and these projecting portions BRG and the recesses ALC are arranged in a staggered pattern relative to each other. According to this embodiment, in addition to the advantageous effects obtained by the sixth embodiment, the tolerance of the mounting space of the projecting portions BRG can be further increased.

Figure 9:
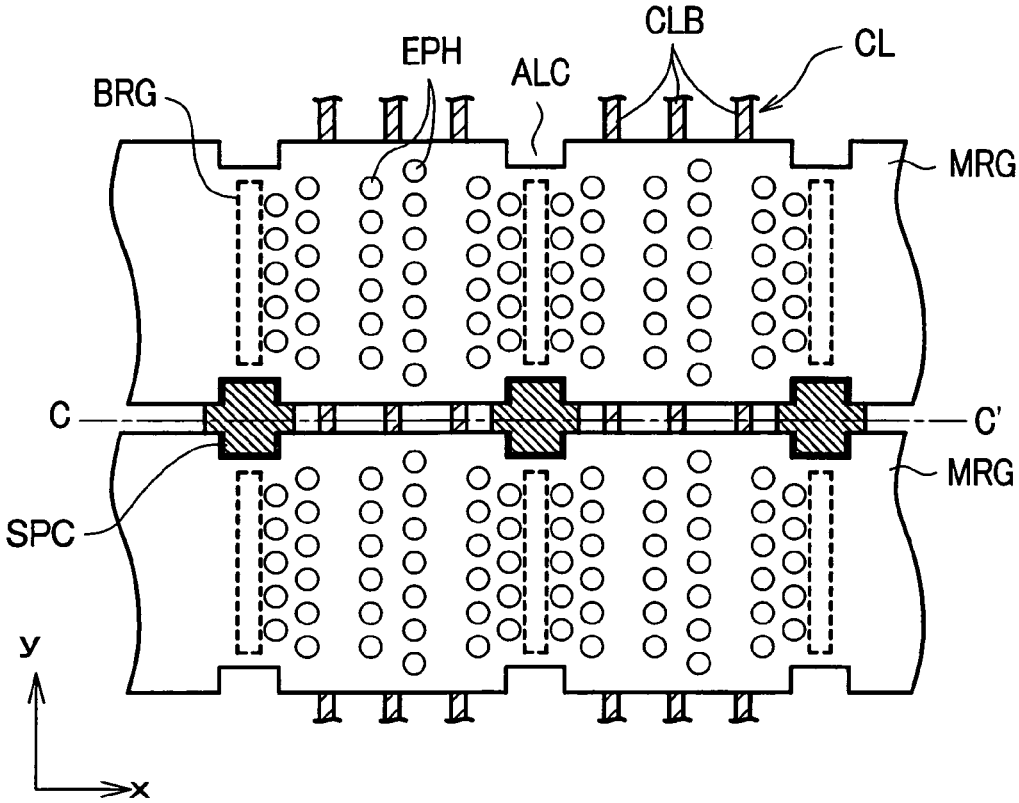
FIG. 9(*a*) is a plan view, and FIG. 9(*b*) is a sectional view taken along line C-C' in FIG. 9(*a*), showing part of the combination of the back panel and the front panel in an eighth embodiment of the display device according to the present invention.
Figure 9:
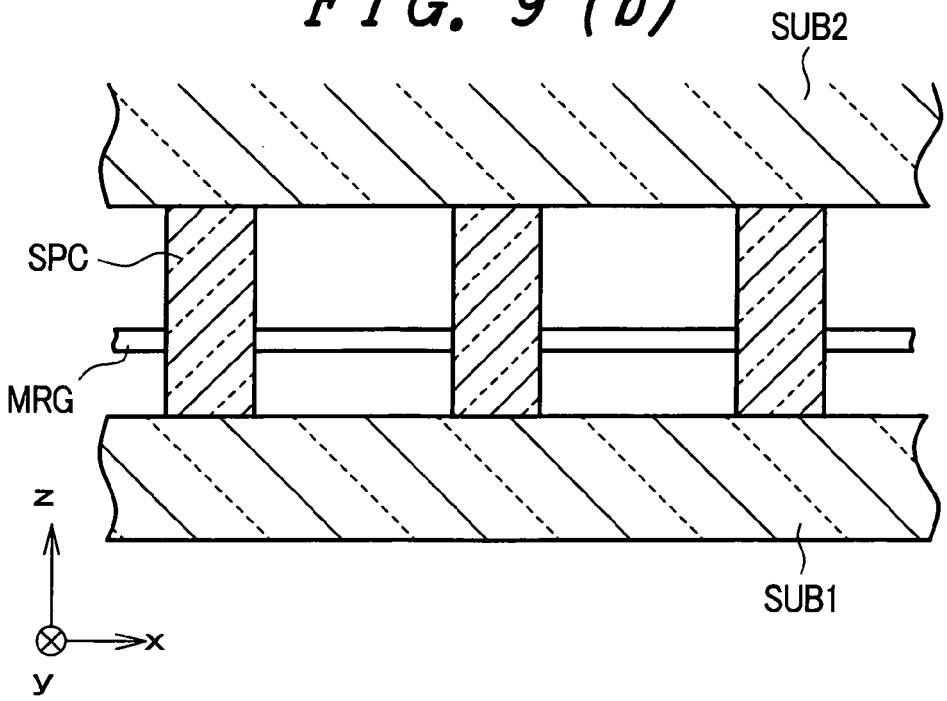

FIG. 9(*a*) and FIG. 9(*b*) show part of the combination of a back panel and a front panel in an eighth embodiment of the display device according to the present invention. FIG. 9(*a*) is a plan view, and FIG. 9(*b*) is a cross-sectional view taken along a line C-C' in FIG. 9(*a*). Here, as seen in FIG. 9(*b*), cathode lines CL that are formed on the back substrate SUB1 and phosphors or the like that are formed on the front substrate SUB2 are omitted from the drawings. In this embodiment, on a back surface of the control electrode MRG, projecting portions BRG, which are elongated in the y direction, are formed. These projecting portions BRG are positioned in the neighboring spaces of the cathode lines CL, which are formed into a group.

Recesses ALC are formed in the control electrode MRG at both end portions of the projecting portion BRG, while recessed portions ALC are formed at similar positions also with respect to neighboring control electrodes MRG. Accordingly, due to a gap defined between the above-mentioned recessed portions ALC of the control electrodes MRG, which are arranged close to each other, and both control electrodes MRG, spaces which cross in the x direction and the y direction are formed. Distance holding members SPC, which regulate a distance between a front panel (front substrate SUB2) and the back substrate SUB1, are mounted in the spaces. The distance holding members SPC are formed of an insulation material, such as glass or the like, and they have an approximately crucifix-shaped cross section and serve to hold the distance between the back substrate SUB1 and the front substrate SUB2 at a given value.

Here, the projecting portion BRG may be formed of a row of a plurality of projecting portions, or it may be formed only at both widthwise ends (end portions of recesses ALC) of the control electrode MRG. Further, in place of these projecting portions BRG, it is possible to adopt insulating layers, similar to the insulating layers described in conjunction with FIG. 5, as projecting portions.

According to this embodiment, by forming the cathode lines into groups, each consisting of a plurality of cathode lines, it is possible to ensure a wide space between respective groups, and, hence, the tolerance for mounting. The control electrodes MRG with respect to the cathode lines CL formed on the back substrate SUB1. With a given gap is enhanced. Further, the mounting tolerance of the distance holding members SPC is enhanced. Accordingly, the front substrate SUB2 can be easily assembled to the back substrate SUB1, while maintaining a given distance between the front substrate SUB2 and the back substrate SUB1.

Figure 10:
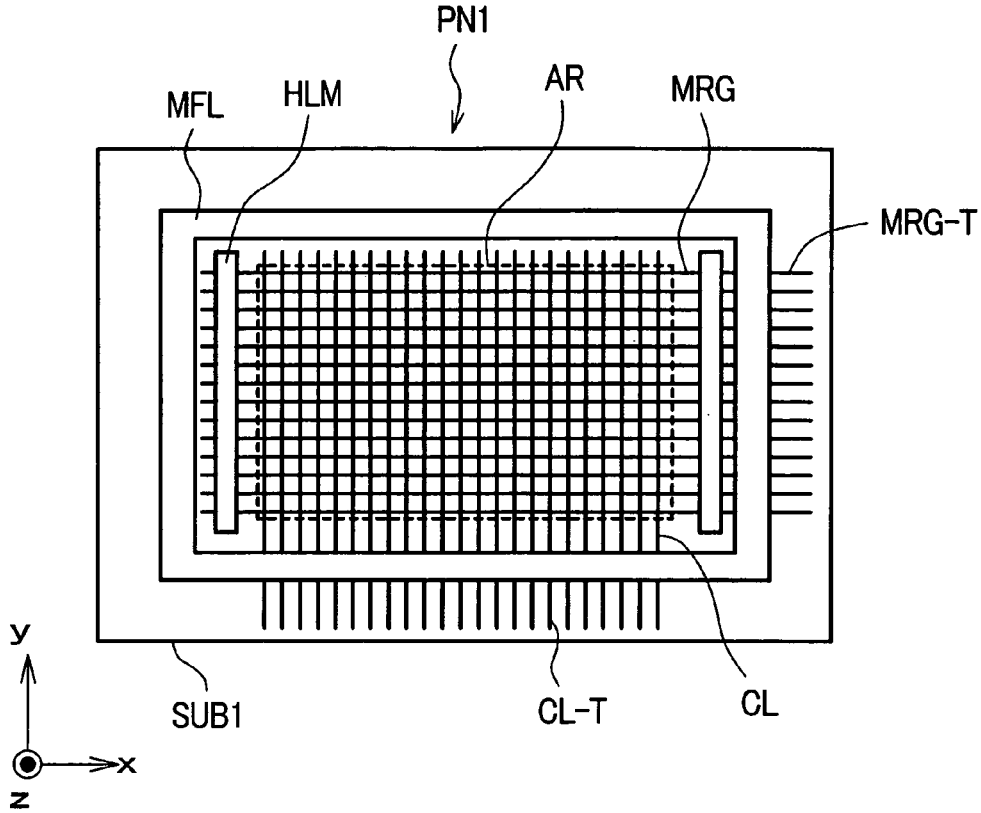
FIG. 10 is a plan view of the back panel showing a sealing frame together with the back panel, as seen when the front panel of the display device according to the present invention is removed.

FIG. 10 is a plan view of a back panel which is shown with a sealing frame, as seen when the front panel of the display device according to the present invention is removed. A back substrate SUB1, which constitutes a back panel PN1, is formed of an insulation material, which is preferably glass, alumina or the like; and, cathode lines CL having electron sources made of the above-mentioned carbon nanotubes and-control electrodes MRG are formed on an inner surface of the back substrate SUB1. The cathode lines CL extend in the y direction and are juxtaposed in a large number in the x direction, which crosses the y direction, on the back substrate SUB1. The cathode lines CL are patterned by printing a conductive paste containing silver or the like and cathode line pull-out terminals CL-T are extended out to the outside of the sealing frame MFL from the end portions of the cathode lines CL. Here, although the cathode line pull-out terminals CL-T are extended out at one side of the back substrate SUB1 in FIG. 10, the cathode line pull-out terminals CL-T may extend out from both sides which face each other in an opposed manner.

The control electrodes MRG are arranged above and close to the cathode lines CL having electron sources. The control electrodes MRG extend in the x direction and are juxtaposed in a large number in the y direction. The control electrodes MRG are fixed to the back substrate SUB1 at fixing portions which are provided outside a display region AR using a pressing member HLM, which is formed of an insulation body made of glass material or the like. The control electrode pull-out terminals MRG-T are connected to the control electrodes MRG in the vicinity of the fixing portions and are extended out to the outside of the sealing frame MFL. Although the control electrode pull-out terminals MRG-T are extended out from only one side of the back substrate SUB1, the control electrode pull-out terminals MRG-T may extend from both opposing sides. A unit pixel is formed at a crossing portion of the cathode line CL and the control electrode MRG. Here, it is also possible to provide the function of the pressing member HLM to the sealing frame MFL.

Then, in response to the potential difference between the cathode lines CL and control electrodes MRG, an emission quantity (including ON/OFF states) of electrons from the electron sources provided to the cathode lines CL is controlled. On the other hand, phosphors and anodes are formed on a front substrate, which constitutes a front panel (not shown in the drawing). The phosphors are formed corresponding to pixels which are formed at crossing portions of the cathode lines CL and the control electrodes MRG.

Figure 11:
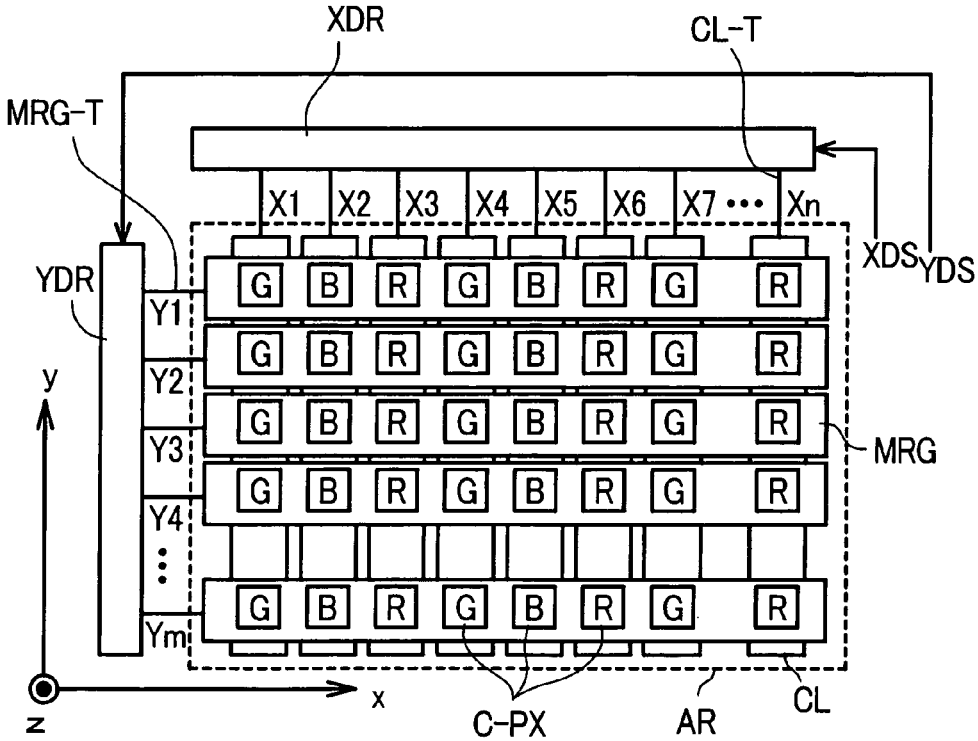
FIG. 11 is a block diagram showing an example of an equivalent circuit of the display device according to the present invention.

FIG. 11 is a block diagram showing an example of an equivalent circuit of the display device of the present invention. A region indicated by a broken line in the drawing indicates a display region AP. In the display region AR, the cathode lines CL and the control electrodes MRG are arranged to cross each other, thus forming a matrix of n×m. Respective crossing portions of the matrix constitute unit pixels and one color trio pixel is constituted of a group of R, G, B, as indicated by C-PX in the drawing. The cathode lines CL are connected to a video signal drive circuit XDR by the cathode line pull-out terminals CL-T-(X1, X2, . . . Xn). The control electrodes MRG are connected to the scanning drive circuit YDR by the control electrode pull-out terminals MRG-T (Y1, Y2, . . . Ym).

The video signals XDS are inputted to the video signal drive circuit XDR from an external signal source, while control signals (synchronizing signals) YDS are inputted to the scanning drive circuit YDP in the same manner. Accordingly, the given pixels which are sequentially selected by the control electrodes MRG and the cathode lines CL are illuminated with lights of given colors so as to display a two-dimensional image. With the provision of the display device having such a constitution, for example, it is possible to realize a flat panel type display device which is operated by a relatively low voltage and, hence, which exhibits high efficiency.

Figure 12:
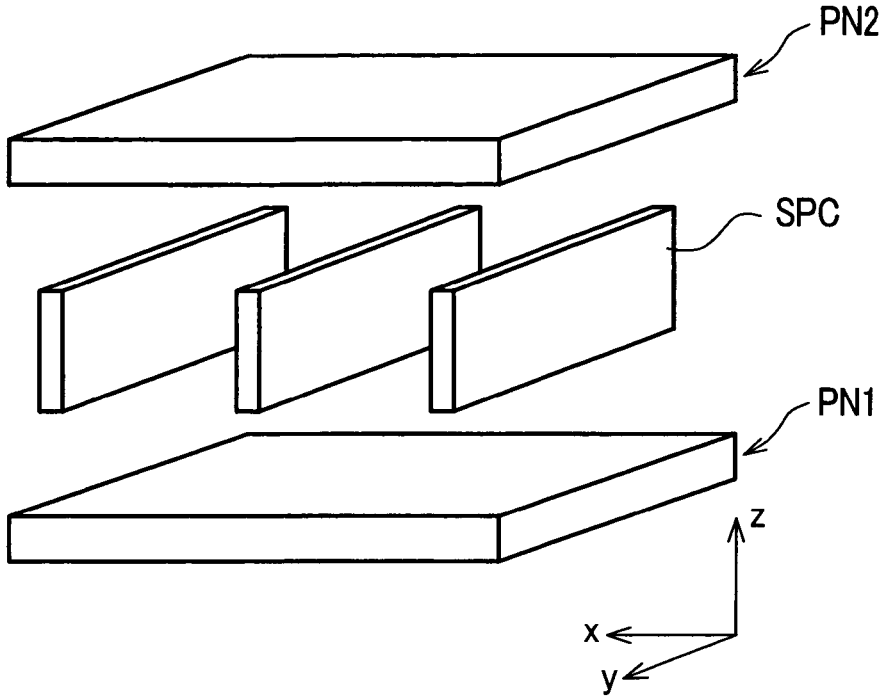
FIG. 12 is a developed perspective view for schematically illustrating one example of a mounting state of distance holding members in the display device according to the present invention.

FIG. 12 shows one example of a setting state of distance holding members at a display device of the present invention. The details of the back panel PN1 and the front panel PN2 are omitted in the drawing. In this example, the distance holding members SPC extend in the y direction, for example, in the extending direction of the cathode lines CL, as described in conjunction with FIG. 9(*a*), for example, and they are juxtaposed in the x direction. These distance holding members SPC are mounted such that a large number of control electrodes MRG are made to traverse over the projected portions BRG formed on the control electrodes MRG in FIG. 9(*a*), for example. Further, these distance holding members SPC are not limited to those which are mounted for every group of cathode lines shown in FIG. 9(*a*), but they may also be mounted for every plurality of groups of cathode lines. Further, the distance holding member SPC may be formed such that the distance holding members SPC traverse a large number of cathode lines CL in the neighboring spaces of the control electrodes MRG shown in FIG. 9(*a*). Also in this case, it is possible to provide the distance holding member SPC for every plurality of control electrodes MRG.

Figure 13:
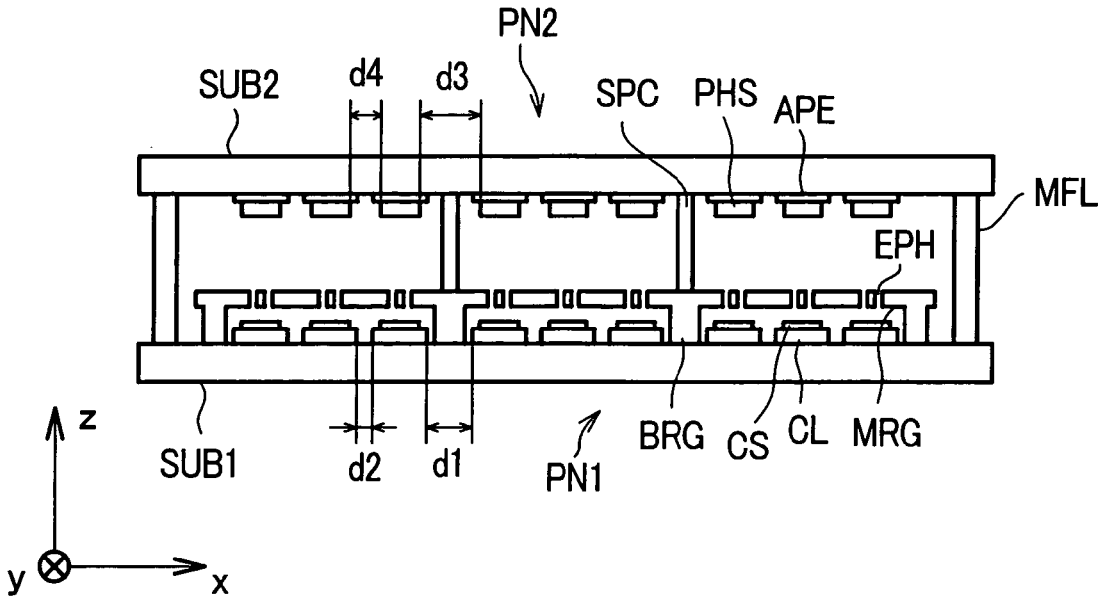
FIG. 13 is a sectional view schematically showing one example of the overall constitution of the display device according to the present invention.

FIG. 13 shows one example of the overall constitution of the display device according to the present invention. The back panel PN1 includes a large number of cathode lines CL, which extend in the y direction and are juxtaposed in the x direction, on an inner surface thereof. The electron sources CS, such as carbon nanotubes, are arranged above the cathode lines CL. Further, the anodes APE and the phosphors PHS are formed on the inner surface of the front substrate PN2. Here, the anodes APE may be formed such that the anodes APE cover the phosphors PHS. The back panel PN1 and the front panel PN2 are restricted to a given distance by the distance holding members SPC. The sealing frame MFL formed of an insulation material, such as glass, is interposed between inner peripheries of the back panel PN1 and the front panel PN2 so as to laminate these panels. The inside of the laminated structure is evacuated.

In this example, the cathode lines CL are formed into groups. Assuming that the gap between the cathode lines CL within the group is d2 and the gap between the neighboring groups is d1, the relationship d1>d2 is established. The projecting portions BRG provided to the control electrodes MRG, which have been described in conjunction with the above-mentioned FIG. 6, are positioned in the gap d1. Further, the distance holding members SPC are mounted on the above-mentioned front-panel PN2-side of the projecting portions BRG and maintain the spacing between the front panel PN2 and the back panel PN1 to a given distance.

Although the phosphors PHS provided to the front panel PN2 may be arranged at an equal interval, in this constitutional example, they are grouped corresponding to the gaps defined between the cathode lines CL. Assuming that the gap between the phosphors PHS within the group is d4 and the gap between the neighboring groups is d3, the relationship d3>d4 is established. Due to such a constitution, it is possible to reduce the quantity of electrons which impact on the phosphors of the neighboring group. Further, the anodes APE may be formed into groups. In this case, given pixels which are sequentially selected by the control electrodes MRG and the cathode lines CL emit light at given colors, thus displaying a two-dimensional image. Due to the features of the display device having such a constitution, it is possible to realize a flat-panel type display device which cam be operated at a relatively low voltage and with a high efficiency.

Figure 14:
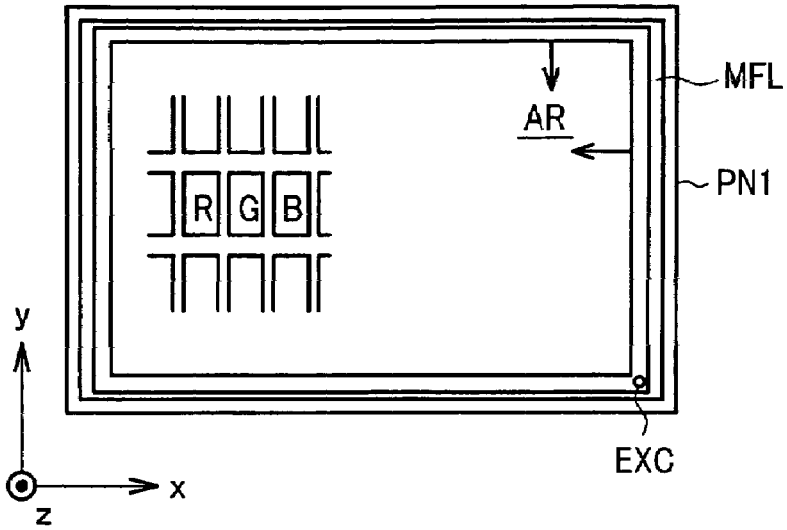
FIG. 14 is a diagram showing an example of the phosphor arrangement on the front panel with respect to the back panel in the display device according to the present invention.

FIG. 14 shows an example of the arrangement of phosphors on the front panel with respect to the back panel of the display device according to the present invention. The display region AR has a rectangular shape with the long sides extending in the x direction, and respective phosphors R, G, B are arranged in the x direction for color display. The x direction represents the extending direction of the control electrodes, the y direction represents the extending direction of the cathode lines, and the z direction represents the front-substrate side direction. In the drawing, reference symbol EXC indicates a position where an exhaust tube is arranged.

Figure 15:
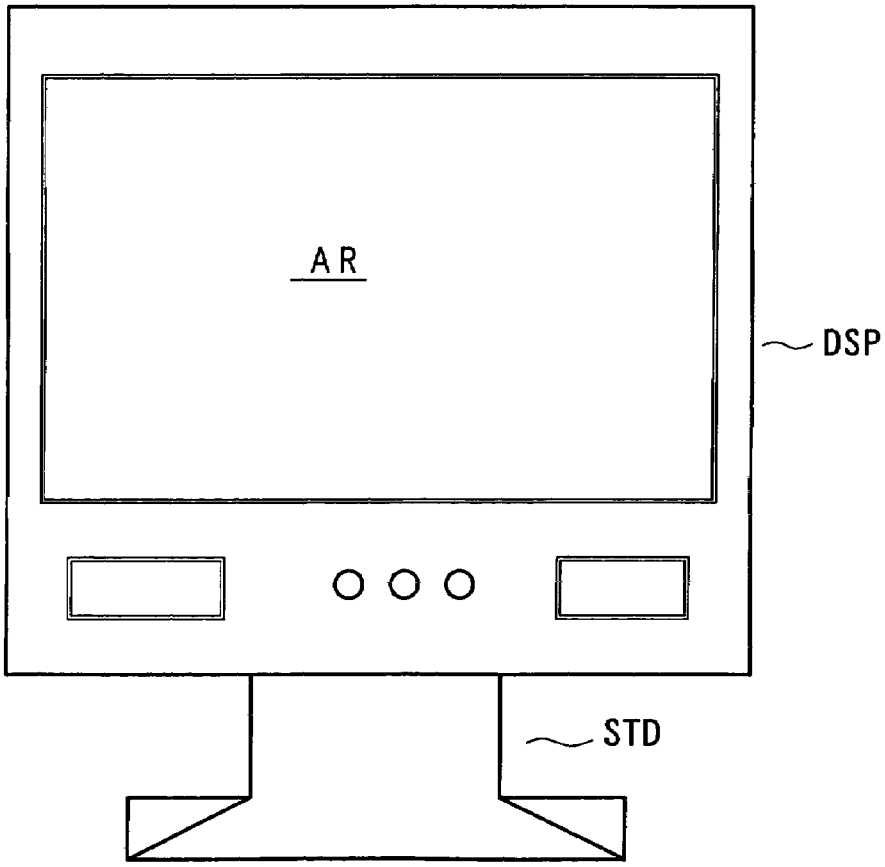
FIG. 15 is a diagram of a television receiver set as an example of electronic equipment on which the display device of the present invention is mounted.
Figure 16:
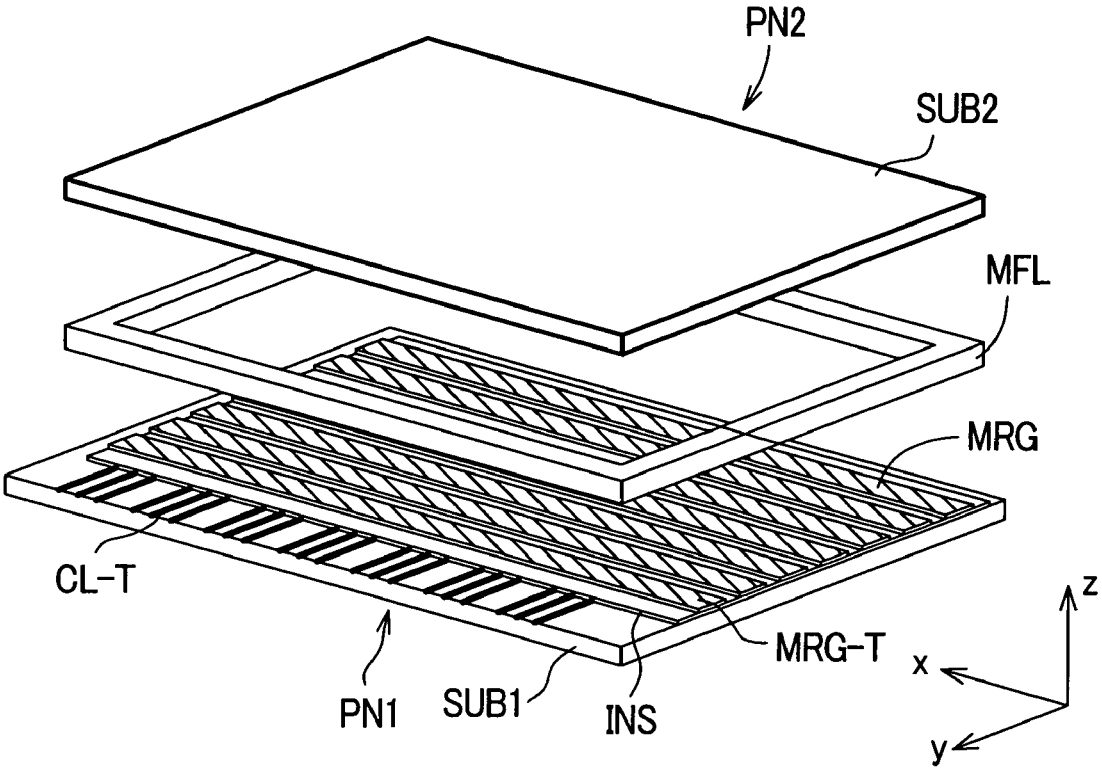
FIG. 16(*a*) is a developed perspective view, and FIG. 16(*b*) is a sectional view, showing the overall structure of an electric emission type display device using ribbon-shaped thin metal plates as the control electrodes.
Figure 16:
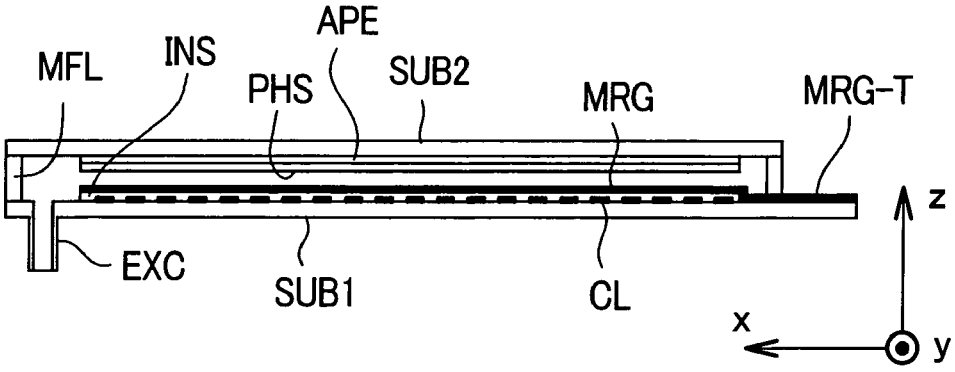

FIG. 15 is a view of a television receiver set, which represents an example of electronic equipment on which the display device of the present invention is mounted. On a display part DSP of the television receiver set, the above-mentioned display device is mounted, and the display part AP is exposed as an viewing window. The display part DSP is erected and held using a stand portion STD. Here, the illustrated shape of the television receiver set is merely an example, and it can take various forms besides the one shown in the drawing.

Although the present invention has been described in conjunction with various embodiments, those constituent elements which are not indispensable in view of the object and advantageous effects of the present invention can be properly omitted or changed. For example, when the structure of the control electrode is not limited to plate members which are produced as separate members, they may be formed of thin films instead of the separate members. Further, it may be possible to adopt an undergate structure in which the control electrodes are arranged as a layer below the cathode lines. Further, it may be possible to adopt a diode construction by omitting the control electrodes. Alternatively, it may be possible to adopt a quadrode construction by adding focusing electrodes.

Further, it may be possible to adopt an active matrix type, which uses active elements, in place of the single matrix type. Also, with respect to the anode structure or the order of laminating the anodes and the phosphors, which have been described previously, it may be possible to adopt the so-called metal back structure in which the anode is made of metal and the phosphors are arranged between the front substrate and the anodes. It is needless to say that various modifications may be considered besides those specifically set forth above.

As has been described heretofore, according to the present invention, the cathode line is formed of a line portion and a cathode portion, wherein the line portion is made narrow to a width which is a required as a minimum for transmitting signals, and the area of the cathode portion on which the electron source is formed is formed with a wide island shape. Further, a plurality of cathode lines are formed into groups (grouping), and respective cathode portions are formed at positions corresponding to the electron passing apertures formed in the control electrodes. Also, the gap between the wiring portions is made small so that a relatively large space is ensured between the neighboring groups of the cathode lines. Further, by making use of this space, the tolerance in mounting the control electrodes on the back substrate and the tolerance in mounting the distance holding members for maintaining the distance between the back substrate and the front substrate at the time of laminating them together to a given value can be increased, whereby the alignment between the electron passing apertures formed in the control electrodes and the cathode lines can be facilitated, thus realizing an easy assembling operation. As a result, it is possible to provide a display device in which the yield rate thereof is achieved, in which the manufacturing cost thereof is reduced and in which a favorable display quality is exhibited.

What is claimed:

1. A display device comprising:

a back substrate having a plurality of cathode lines which extend in a first direction and are juxtaposed in a second direction which crosses the first direction, and a plurality of control electrodes, which extend in the second direction, are juxtaposed in the first direction, and are insulated from the cathode lines, on an inner surface thereof; and a front substrate which is arranged to face the back substrate in an opposed manner with a set distance therebetween, and which has phosphors and an anode which constitute a display region, on an inner surface thereof;

wherein distance holding members for maintaining the set distance between the back substrate and the front substrate are provided inside of the display region;

wherein the phosphors are constituted of three colors, and the cathode lines are formed into groups each consisting of three cathode lines corresponding to the three colors;

wherein the plurality of cathode lines include line portions, which extend in the first direction, and cathode portions which are wider in the second direction than the line portions; and wherein electron sources are formed on the cathode portions.

2. A display device according to claim 1, wherein the distance between the cathode lines in the neighboring groups is set to be equal to the distance between the cathode lines within the same group.

3. A display device according to claim 1, wherein the distance between the cathode lines in the neighboring groups is set to be larger than the distance between the cathode lines within the same group.

4. A display device according to claim 1, wherein the cathode portions which are positioned away from the center of each group of the cathode lines toward the end side in the second direction are asymmetrical with respect to the line portion which constitutes the cathode portion.

5. A display device according to claim 1, wherein the cathode portion of the cathode line at the center of the group is symmetrical with respect to the extending direction of the line portion and the cathode portions of the cathode lines at both sides of the group are asymmetrical with respect to the extending direction of the line portion.

6. A display device according to claim 1, wherein an insulating layer which maintains the control electrodes on a back substrate at a set gap is arranged between the groups.

7. A display device according to claim 1, wherein projecting portions which are brought into contact with the back substrate and maintain a set gap between the control electrodes and the back substrate are provided at the back substrate side of the control electrodes, and the projecting portions are positioned between the groups.

8. A display device according to claim 1, wherein the distance holding members are arranged between the groups.

9. A display device according to claim 1, wherein the distance holding members are brought into contact with the back substrate between the control electrodes.

* * * * *